US011059500B2

(12) United States Patent
Coester et al.

(10) Patent No.: US 11,059,500 B2
(45) Date of Patent: Jul. 13, 2021

(54) ELEVATED GUIDEWAY WITH PROPULSION DUCT FOR PNEUMATIC TRANSPORT

(71) Applicants: Ariane Coester, Porto Alegre (BR); Marcus Coester, Porto Alegre (BR); Tatiana Coester, Porto Alegre (BR); Juliana Coester, Porto Alegre (BR)

(72) Inventors: Ariane Coester, Porto Alegre (BR); Marcus Coester, Porto Alegre (BR); Tatiana Coester, Porto Alegre (BR); Juliana Coester, Porto Alegre (BR)

( * ) Notice: Subject to any disclaimer, the term of this patent is extended or adjusted under 35 U.S.C. 154(b) by 227 days.

(21) Appl. No.: 16/329,284

(22) PCT Filed: Jul. 6, 2018

(86) PCT No.: PCT/BR2018/050228
§ 371 (c)(1),
(2) Date: Feb. 28, 2019

(87) PCT Pub. No.: WO2019/006532
PCT Pub. Date: Jan. 10, 2019

(65) Prior Publication Data

US 2019/0225241 A1 Jul. 25, 2019

(30) Foreign Application Priority Data

Jul. 7, 2017 (BR) ..... BR 102017014747-9

(51) Int. Cl.
*B61B 13/12* (2006.01)
*B61C 11/00* (2006.01)

(52) U.S. Cl.
CPC ..... *B61B 13/122* (2013.01); *B61B 13/12* (2013.01); *B61C 11/00* (2013.01)

(58) Field of Classification Search
CPC ..... B61B 13/12; B61B 13/122; B61B 13/04; B61B 13/10; B61C 11/00; E01B 25/00;
(Continued)

(56) References Cited

U.S. PATENT DOCUMENTS 83,196 A * 10/1868 Montgomery ..... 14/74.5
2,618,146 A * 11/1952 Ciarlini ..... E04B 1/215 52/252

(Continued)

FOREIGN PATENT DOCUMENTS

BR PI 7703372 12/1978
BR PI 7906255 8/1980

(Continued)

OTHER PUBLICATIONS

International Search Report dated Sep. 6, 2018 in corresponding PCT International Application No. PCT/BR2018/050225.

(Continued)

*Primary Examiner* — Mark T Le
(74) *Attorney, Agent, or Firm* — Ostrolenk Faber LLP

(57) ABSTRACT

An elevated guideway performing the function of supporting, guiding and propelling pneumatic transport vehicles for passengers and loads. The two-part elevated guideway is formed by two components, each corresponding to one side of the cross section, divided by a vertical axis passing through the center of the slot. Components are not symmetrical, the left hand component having a wider top table. Components are joined through a niche already present at the lower slabs which is filled with a structural resin. Niche for joining the two-part elevated guideway has a central type female-female fitting. The elevated guideway includes guideway guards, two additions for installing the propulsion duct slot seal, tubes for the electric power supply and telecommunication and control cables, the protective railing for protection in the side emergency gangway, the unit for securing the rail via the web thereof, rails and the third and fourth electric power supply rails of the vehicle. The two-part elevated guideway may have, combined on the same
(Continued)

beam of the propulsion duct, a secondary propulsion duct, thereby forming a single, non-separable structure.

10 Claims, 6 Drawing Sheets

(58) Field of Classification Search
CPC . E01B 2/00; E01B 2/003; E01D 18/00; E01D 2101/26; E01D 2/00; E01D 2/04
USPC ..... 104/124
See application file for complete search history.

(56) References Cited

U.S. PATENT DOCUMENTS

| | | | | |
|---|---|---|---|---|
| 3,722,424 | A | 3/1973 | Van Veldhuizen | 104/23 FS |
| 4,658,732 | A * | 4/1987 | Coester | B61C 11/06 104/156 |
| 4,774,891 | A | 10/1988 | Coester | 104/130 |
| 5,092,710 | A * | 3/1992 | Matiere | E03F 3/04 138/105 |
| 5,386,782 | A * | 2/1995 | Dinis | E01D 2/04 104/124 |
| 5,845,582 | A | 12/1998 | Coester et al. | 104/156 |
| 6,178,892 | B1 | 1/2001 | Harding | 104/155 |
| 2004/0244635 | A1 | 12/2004 | Schlienger | 104/138.1 |
| 2010/0175961 | A1 * | 7/2010 | Rameau | B60M 1/307 191/22 DM |

FOREIGN PATENT DOCUMENTS

| | | | |
|---|---|---|---|
| BR | 8301706 | A | 11/1984 |
| BR | 8503504 | A | 9/1986 |
| BR | PI 9502056-0 | A | 8/1997 |
| BR | PI 9814160-0 | | 9/2000 |
| BR | PI 9912112-3 | | 5/2001 |
| BR | PI 0805188-7 | A2 | 2/2012 |
| BR | PI 0901119-6 | A2 | 5/2012 |

OTHER PUBLICATIONS

Written Opinion dated Sep. 6, 2018 in corresponding PCT International Application No. PCT/BR2018/050228.

* cited by examiner

ELEVATED GUIDEWAY WITH PROPULSION DUCT FOR PNEUMATIC TRANSPORT

CROSS-REFERENCE TO RELATED APPLICATIONS

The present application is a 35 U.S.C. §§ 371 national phase conversion of PCT/BR2018/050228, filed Jul. 6, 2018, which claims priority to Brazilian Patent Application No. BR 102017014747-9, filed Jul. 7, 2017, the contents of which are incorporated herein by reference. The PCT International Application was published in the Portuguese language.

INTRODUCTION

The present invention refers to an improvement developed for elevated guideway performing the function of supporting, guiding and propelling pneumatic transport vehicles for passengers and loads.

STATE OF THE ART

Patent documents PI 7703372-8, PI 7906255-5, PI 8301706-2, PI 8503504-1, PI 9502056-0, PI 9814160-0, PI 9912112-3, PI 0805188-7 and PI 0901119-6 disclose a pneumatic transport system comprising light vehicles preferably provided with trucks, each containing four metallic wheels with at least one of the axles connected to a pylon bolted to a propulsion plate, which is responsible for the conversion of the fluid thrust into mechanical work for moving the vehicles over rails seated on a special elevated guideway.

Mounted on vertical pillars, the elevated guideway, besides the classic function of supporting and guiding the vehicles, is also characterized by comprising a propulsion duct, a device intended to create a physical means for containment and spreading of the air flow generated by stationary power propulsion units. Made up of a heavy duty industrial blower and a valve set, the power propulsion units are responsible for increasing or reducing pressure in the hollow interior of the beams forming the elevated guideway.

The vehicle propulsion plate pylon moves longitudinally along the beams comprising the superstructure of the elevated guideway, which, conveniently, have an open profile cross section for allowing free passage of the propulsion plate through a central slot in the upper slab thereof. Documents PI 7906255-5, PI 8301706-2, PI 9814160-0, PI 0805188-7 and PI 0901119-6 describe this slot which is sealed preferably by the physical arrangement of two or more strips or tubes made of high strength and durability material, with excellent mechanical memory and with low superficial friction.

The beams of the elevated guideway superstructure can be made of concrete, steel, composite or mixed material, designed to absorb accidental loads caused by movement of the vehicle, as well as to withstand the dynamic strains of pressurization and depressurization within the propulsion duct.

The propulsion duct is bounded by the interior of the elevated guideway which can present typical cross sections of 0.49 $m^2$, 1.0 $m^2$, 1.44 $m^2$ and 1.96 $m^2$, depending, among other factors, on the thrust necessary to meet the designed transport capacities, on the dynamic performance, on the presence of sharp ramps in the altimeter project and on other related factors as well, which are analyzed on a case-to-case basis.

Document PI 9502056-0 discloses a secondary propulsion duct, which is mounted in parallel with the propulsion duct and allows the air flow generated by the power propulsion units to be discharged into the propulsion duct in two distinct positions, resulting in thrust on the propulsion plate of a vehicle located in the influence zone of the secondary propulsion duct. The zone of the secondary propulsion duct is normally positioned in the center region of the boarding platform of the stations, one being required for every guideway. The extension thereof is at least equivalent to the length of the longest vehicle designed to operate in the specific line This document neither gives details as to the technical and constructional features of the secondary propulsion duct nor describes its connections with the elevated guideway, being it restricted to present a mere schematic simplified diagram.

SOLUTION OF THE INVENTION

The object of the present invention is an improvement in elevated guideway for supporting, guiding and propelling pneumatic transport vehicles for passengers and loads that effectively surpasses said limitations of the state of the art.

In long distance and/or large traffic volume schedules, the most suitable structure for the elevated guideway from the technical and economic standpoint is now in prestressed and reinforced concrete, where the main elements of the beams and pillars are prefabricated parts. Armatures are left on the top of the pillars for integral connection with the respective mesostructured beams, and this is accomplished after the connection of pillars to the infrastructure (foundations).

Produced on the building site, the superstructure beams are preferably made in two halves and, to this end, two distinct sets of formworks molding the components are used, each corresponding to one of the sides of the cross section which is divided in the vertical axis positioned in the slot center. The components are not symmetrical, which most important distinction is that the left two-part component has a wider top table, to be used as an integrated emergency gangway for passengers and access of the maintenance team.

The manufacture of straight beams is carried out starting from formworks covering the full span length, whereas that of the curved beams is carried out through smaller modules carefully positioned in relation to each other on a fixed base, so as to form a polygonal line approaching with high degree of accuracy any designed continuous geometry.

After being transported and correctly positioned on the mesostructure, both components are joined through a niche already present in the lower slab. This juncture is made by means of a female-female type central fitting which is filled with a suitable structural resin. Subsequently, by means of connection armatures, the superstructure beam is made integral with the previous one and with the support structure for providing continuity to the elements forming the line.

The superstructure beams are designed to have a standard span of 30 m, with expansion joints at every 120 m, or four spans. According to the application, several other combinations are possible, without cross section change, such as for example increasing the standard span to 40 m, with expansion joints also at every 120 m or three spans.

The result is a structure forming porches to obtain a set with rigidity and dampening features capable of supporting the wind and/or seismic loads, gravity forces and vehicle mobile loads. Once the assembling process is ended, the beam is ready to receive its guideway protector and the two additions for installing the slot sealing components of the propulsion duct.

The guideway guard is made up of parts prefabricated separately from the rest of the beam structure, and it may be made of concrete or steel, within which tubes are embedded for receiving, on one side, electrical power supply cables and, on the other side, the control and telecommunications cables.

At the central ends defining the slot in the table of the propulsion duct there are struts for further fastening or molding the parts containing the exact angles for the correct mounting of the seal, in such a way to ensure its perfect tightness. These parts should be preferably made of micro-concrete, metallic material, or some other suitable equivalent for the application.

As the last step of the assembly process the complements of the elevated guideway are installed, including: the protective railing for protection on the side emergency gangway, the rail fastening set through the web thereof, the rails for movement of the vehicle, the propulsion duct slot seal, the third and fourth vehicle electrical power supply rails, among others, according to the specific application The present invention also relates to the cross section of the concrete beams containing the secondary propulsion duct. The secondary propulsion duct combined with the propulsion duct on the same beam forms a single non-separable structure with the latter. Being composed in a homogeneous manner, the beams comprise the standard propulsion duct, whose area is the default area of the propulsion plate and with the secondary propulsion duct in its lateral side, the latter being of closed section and smaller area, being used only for maneuvering a vehicle inside the boarding station zone and the power propulsion unit on predetermined operating situations.

The manufacturing process of the beams for the secondary propulsion duct follows the same principle as the one established for the beams characterizing only the propulsion duct, that is, the splitting of its structure in two. The difference is that the left two-part component is kept unchanged, whereas the right two-part component requires a specific formwork for molding the secondary propulsion duct.

The further steps of rendering the beams integral, adding of the guideway protector, the addition for installing the propulsion duct slot seal and the remaining guideway complements remain identical.

ADVANTAGE OF THE INVENTION

The new concept of elevated guideway for pneumatic transport system provides a beam manufacturing method of which the differential is a two-part cross section, contrary to prior art which uses a beam produced in a single step with monolithic form.

A substantial time saving is obtained by the innovative process due to its simplicity, fully dispensing with the use of internal molds for shaping the propulsion duct, eliminating the drawbacks of working in a confined environment and the difficulties in controlling concrete fluidity for homogenously filling the lower slab resulting in a homogeneous trace beam.

Additionally, manufacturing can be accelerated due to the higher serializing potential of the building site, since mechanical precision elements, which require fine adjustments, are treated separately in a second independent step, not influencing the rate of the first step, and making use of a team specially trained for this purpose.

The hyperstatic characteristic of the novel structure, differently from what is described in previous patents, expands the possibilities of advancing the elevated guideway superstructure in longer spans between pillars and with the section being maintained slender. This gain is still more pronounced in closed radius curves in which the beams being made integral with each other assure stability of the whole without requiring shortening of the standard span in the section involved. The solution of the invention keeps the center of gravity perfectly within the required limits by the security regulations against tipping, thus allowing for flexibility to overcome urban obstacles with the least possible visual impact.

The advantage of the beams forming the secondary propulsion duct resides in the simplicity of fitting the beam design employed in the remaining sections of the elevated guideway, in which only the propulsion duct is required. This is achieved by the addition of a lateral appendix oriented, due to technical and functional reasons, in the direction of the boarding platform of passenger stations, and which is made from the same material as the propulsion duct, and this adds inertia and stability to the original structure.

The invention further benefits from the production in two halves and in multiple steps, and the resulting elevated guideway aggregates robustness and durability with reduction of air flow noise along its trajectory, in addition to the low visual impact of a single and integrated structure of which the volume is partially hidden from passersby when they contemplate the elevated guideway.

DETAILED DESCRIPTION OF THE INVENTION

The improvement in elevated guideway for supporting, guiding and propelling pneumatic transport vehicles for passengers and loads, object of the present invention, will be now described in detail based on the enclosed drawings, listed hereinafter:

FIG. 1—perspective view of an elevated guideway of the state of the art;

FIG. 2—front view of the elevated guideway of the state of the art with a lower and independent secondary propulsion duct;

FIG. 3—side view of the elevated guideway of the state of the art with a lower and independent secondary propulsion duct;

FIG. 4—perspective view of the two-part elevated guideway of the invention;

FIG. 5—exploded perspective view of the two-part elevated guideway of the invention;

FIG. 6—perspective view of the two-part elevated guideway with their accessories installed;

FIG. 7—perspective view of a detail of the addition for installing the duct slot seal;

FIG. 8—perspective view of a detail of rail installation, of the electrical power supply and of the electrical duct;

FIG. 9—side view of the two-part elevated guideway;

FIG. 10—side view of the two-part elevated guideway made up of the propulsion duct and secondary duct.

FIG. 1 illustrates a known elevated guideway (1) for pneumatic transport system which is formed of light vehicles provided preferably with trucks (2) each containing four metallic wheels (3) each, at least one of the axles (4) being connected to a pylon (5) bolted to a propulsion plate (6), which is responsible for converting the thrust of the fluid flow rate in the interior of the duct (7) performing mechanical work for moving the vehicles over rails (8) seated on the elevated guideway.

FIGS. 2 and 3 illustrate a section of the known elevated guideway (1) which is positioned on the zone of the boarding platform and which is mounted on vertical pillars (9). The elevated guideway (1), besides the classic function of supporting and guiding the vehicles, is further characterized by comprising a propulsion duct (7) for containment and spreading of the air flow generated by stationary power propulsion units (10). The elevated guideway (1) has an open profile cross section to allow free passage of the propulsion plate through a central slot (11) in its top table (12). Under the elevated guideway (1) a secondary propulsion duct (13) is disposed mounted in parallel with propulsion duct (7) and allows the air flow generated by the power propulsion unit (10) to be discharged in the propulsion duct (7) in two distinct portions, resulting in thrust on the propulsion plate of a vehicle located within the platform zone of secondary propulsion duct. The zone of the secondary propulsion duct (13) is normally positioned in the center region of the boarding platform of the stations, one being necessary for each guideway. The extension thereof is at least equivalent to the length of the longest vehicle designed for operating in a specific application.

FIGS. 4 and 5 illustrate the two-part elevated guideway (20) of the invention formed by two components (21 and 22), each one corresponding to one of the sides of the cross section which is divided by the vertical axis passing through the center of slot (23). Components (21 and 22) are not symmetrical, and they present the important distinction that the left two-part component (22) has a wider top table (24) to be used as integrated emergency gangway for passengers and access of maintenance team of the pneumatic transport system.

After being transported and positioned on the mesostructure, both components (21 and 22) are joined through a niche (25) already present in the lower slabs (26). Preferably, this junction is made from a female-female type central fitting, which is filled with a suitable structural resin. Guideway guards (27) and the two additions (28) for installing the propulsion duct slot seal integrate the elevated guideway.

FIGS. 6 and 9 show details of assembling the two-part elevated guideway with non-symmetrical components (21 and 22), the junction of the lower slabs (26) filled with a structural resin (25), the guideway guards (27), the two additions (28) for installing the propulsion duct slot seal, tubes (29) for receiving the electrical power cables and telecommunications and control cables, the protective railing (31) for protection in the side emergency gangway.

Figure 1:
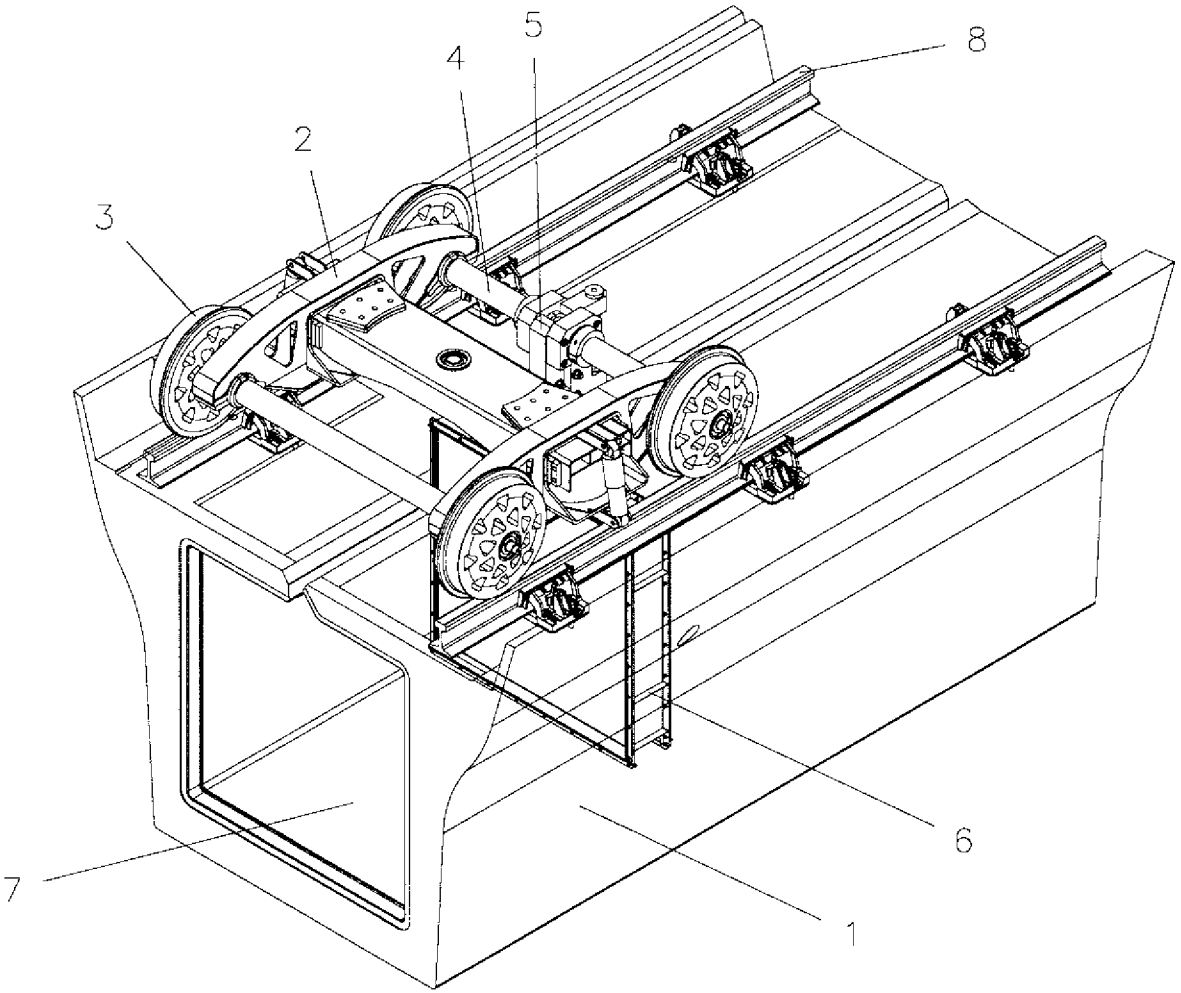
FIG. 1 PRIOR ART
Figure 2:
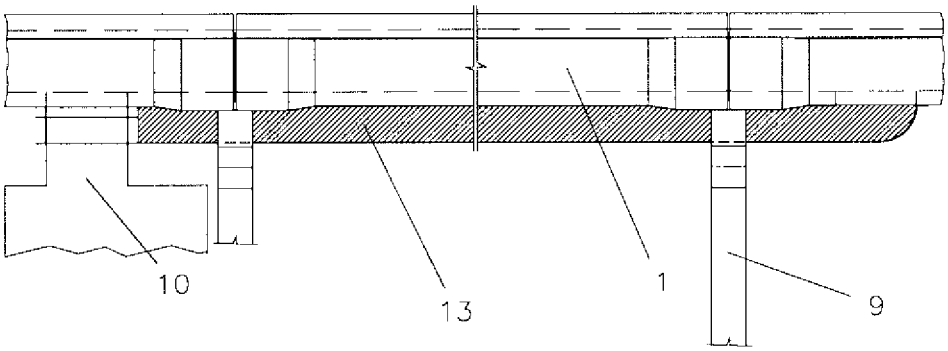
FIG. 2 PRIOR ART
Figure 3:
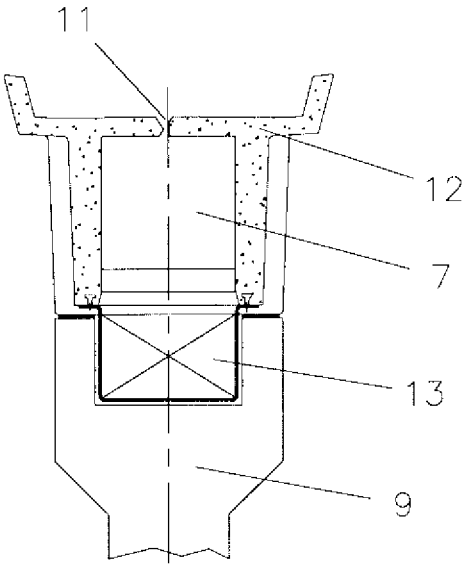
FIG. 3 PRIOR ART
Figure 4:
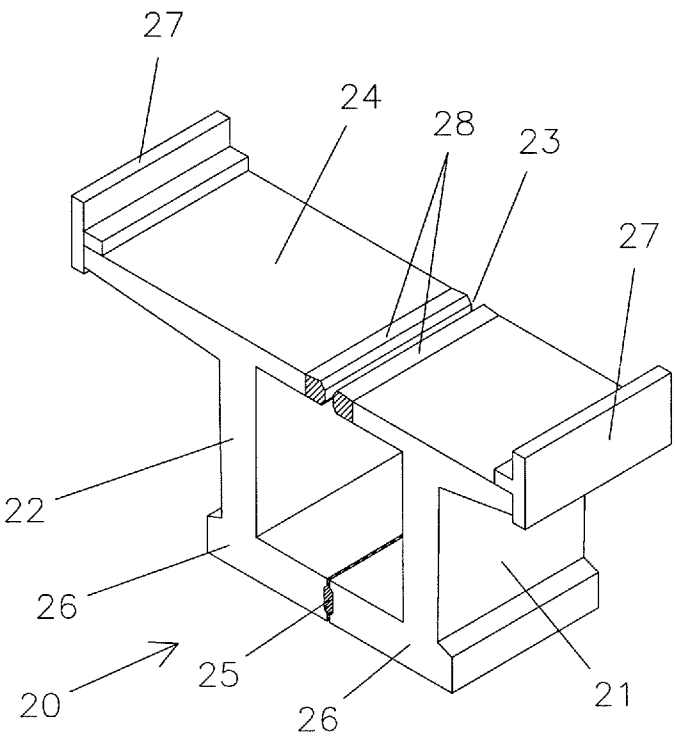
Figure 5:
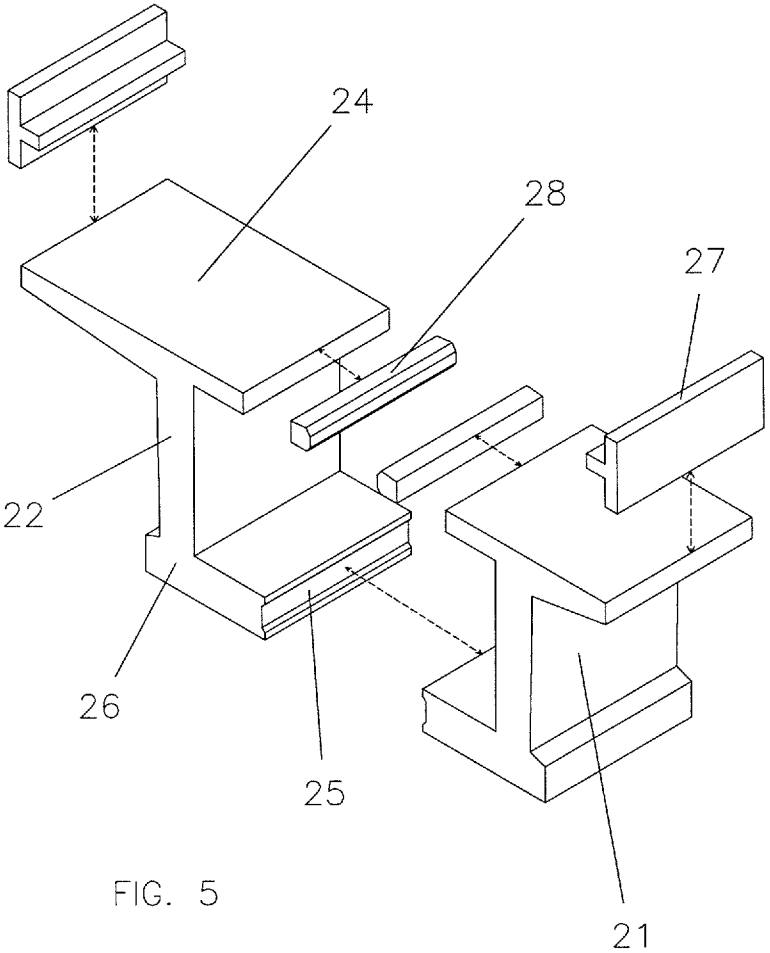
Figure 6:
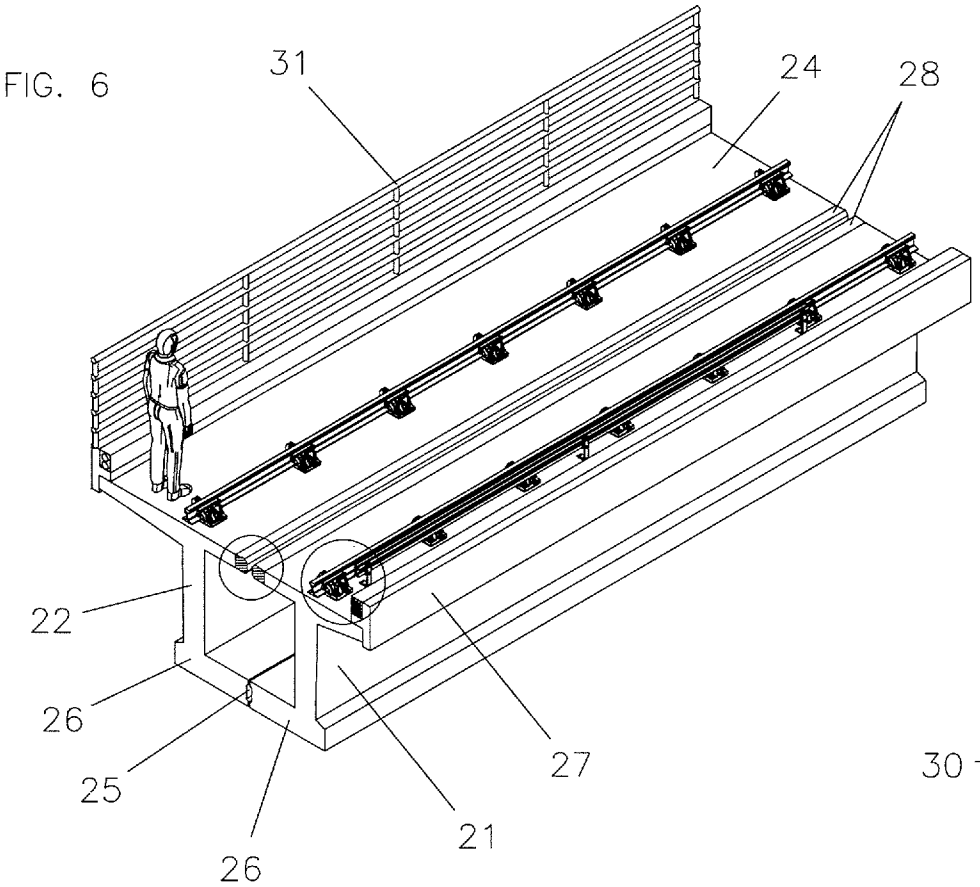
Figure 8:
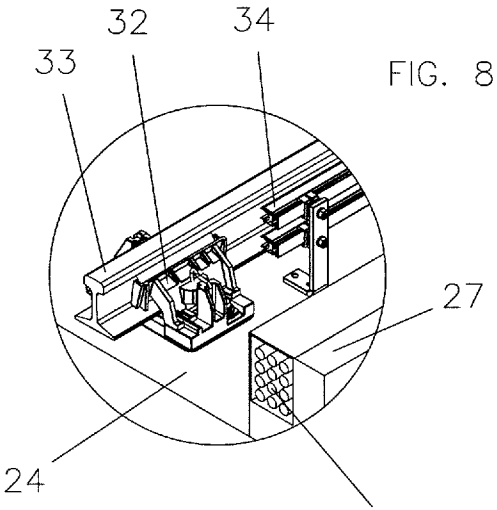
FIG. 8 shows details of the remaining complements of the elevated guideway, including the unit for securing the rail (32) through the web thereof, rails (33) and third and fourth rails (34) for electrical power supply of the vehicle.
Figure 7:
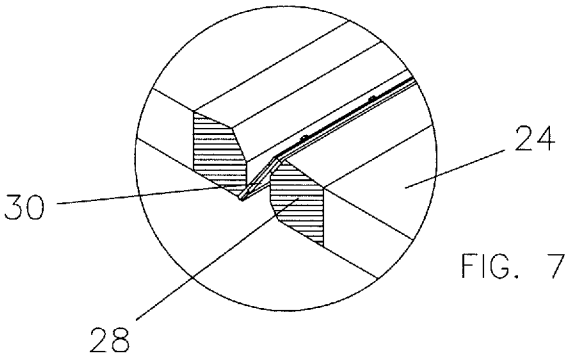
FIG. 7 shows details of the central edges of components (21 and 22) defining the slot (23) in the table (24) of the propulsion duct having struts for later fastening or molding of additions (28) with angles for mounting the seal (30).
Figure 9:
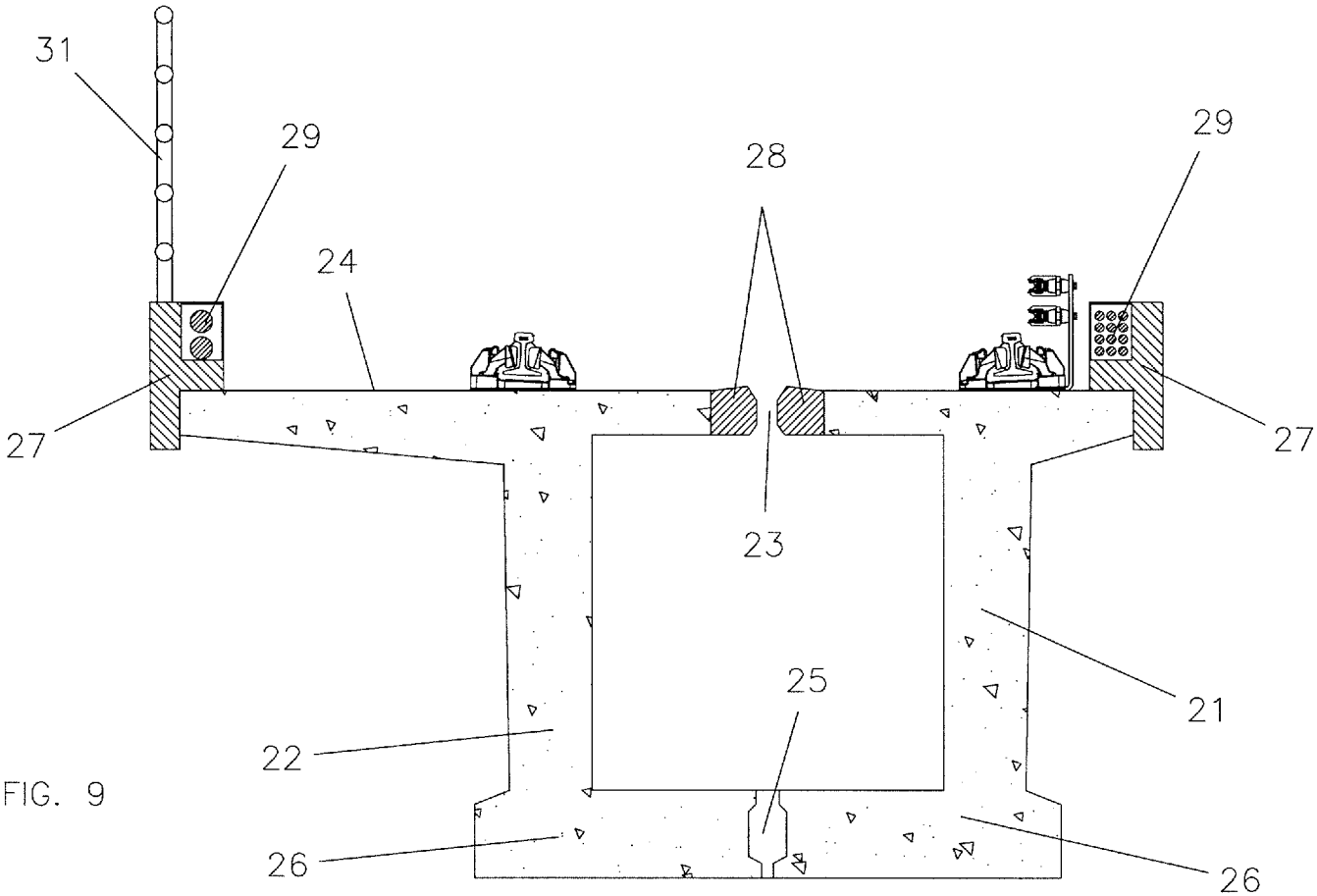
Figure 10:
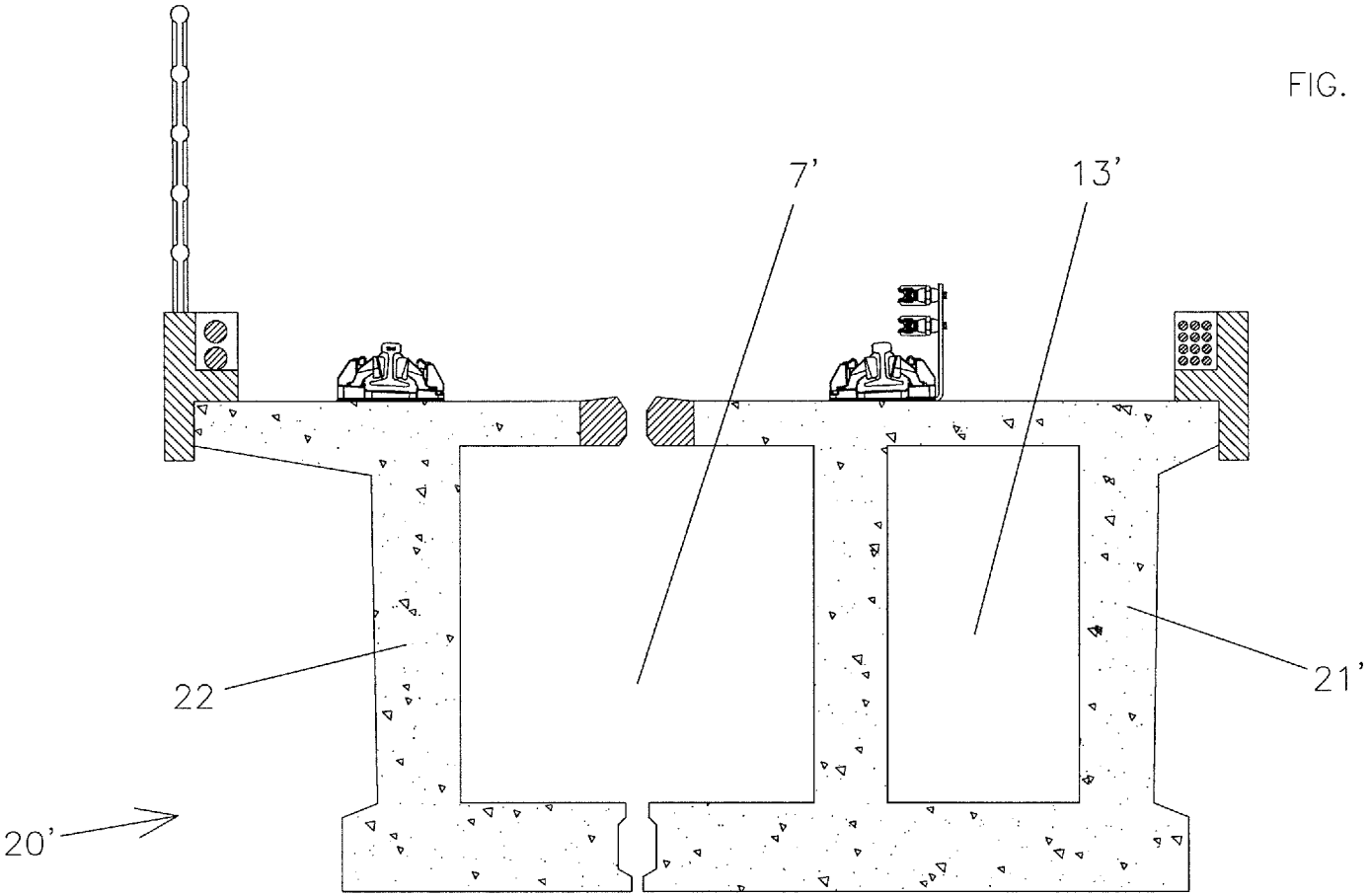

FIG. 10 shows details of a constructive option of the two-part elevated guideway (20') of the invention consisting of combining on one same beam the propulsion duct (7') and the secondary propulsion duct (13'), forming a single and non-separable structure. The beam is formed in a homogeneous manner and includes the standard propulsion duct (7'), of which the area is the default area of the propulsion plate, and with the secondary propulsion duct (13') in the side thereof, the latter being of closed section and smaller area, used only for maneuvering a vehicle within the boarding station zone and of the power propulsion unit in predetermined operational situations.

The manufacturing process of the beams for the secondary propulsion duct (13') follows the same principle as the one established for the beams characterizing only the propulsion duct (7'), that is, the splitting of its structure in two. The difference is that the left two-part component (22) is kept unchanged, whereas the right two-part component (21') requires a specific formwork for molding the secondary propulsion duct (13').

The invention claimed is:

1. An elevated light vehicle guideway for enabling pneumatic transport of a light vehicle on the guideway, wherein the light vehicle includes a propulsion plate attached to the vehicle for moving the vehicle on the elevated guideway;

the guideway comprising:

a top table of the guideway extending along a length of the guideway supporting movement of the vehicle on the top table;

a propulsion duct below the top table of the guideway, the propulsion duct being configured for containment of and for spreading of air along the duct;

a power propulsion unit located and operable for generating an air flow in the propulsion duct for causing the propulsion plate to be moved in the propulsion duct which moves the vehicle on the top table;

the elevated guideway having an open profile cross-section for passage of the propulsion plate below and along the guideway;

a slot in the top table of the guideway, the elevated guideway is comprised of two side by side guideway components, which are split at the slot between the two side by side components, each corresponding to one of the sides of the open profile and thereby both providing the slot between the two-components including the top table, and a connection extends vertically between the propulsion plate in the propulsion duct and the vehicle on the top table of the guideway above the propulsion plate; and the two-components having a niche at lower slabs thereof, wherein the lower slabs are jointed together at the niche.

2. The elevated guideway with a propulsion duct for pneumatic transport according to claim 1, further comprising the joining of the two-component elevated guideway is made by means of a female-female central fitting.

3. The elevated guideway with a propulsion duct for pneumatic transport according to claim 1, wherein the guideway has guards located outward of the vehicle along the guideway.

4. The elevated guideway with a propulsion duct for pneumatic transport according to claim 1, wherein the components have respective additions for installing a slot seal of the propulsion duct to be integrated in the elevated guideway.

5. The elevated guideway with a propulsion duct for pneumatic transport according to claim 1, further comprising tubes extending along the guideway for power supply and telecommunications and control cables.

6. The elevated guideway with a propulsion duct for pneumatic transport according to claim 1, further comprising a protective railing for protection on a side emergency gangway at the top table.

7. The elevated guideway with a propulsion duct for pneumatic transport according to claim 1, further comprising a unit for securing a rail on the top table through a web of the rail on the top table.

8. The elevated guideway with a propulsion duct for pneumatic transport according to claim 1, further comprising the rail and a power supply rail are integrated in the elevated guideway.

9. The elevated guideway with a propulsion duct for pneumatic transport according to claim 1, wherein on a same propulsion duct beam of the two-component elevated guideway, there is combined a secondary propulsion duct, and the propulsion ducts form a single and non-separable structure.

10. The elevated guideway in claim 1, wherein the top table includes top table components having respective different widths across the guideway.

* * * * *